US008393486B2

(12) United States Patent
Cap et al.

(10) Patent No.: US 8,393,486 B2
(45) Date of Patent: Mar. 12, 2013

(54) WATER STORAGE EVAPORATION CONTROL

(75) Inventors: George Jaroslav Cap, Robertson (AU); Ross Woodfield, East Brisbane (AU)

(73) Assignee: Aqua Guardian Group Ltd. (AU)

( * ) Notice: Subject to any disclaimer, the term of this patent is extended or adjusted under 35 U.S.C. 154(b) by 1066 days.

(21) Appl. No.: 11/572,583

(22) PCT Filed: Jul. 27, 2005

(86) PCT No.: PCT/AU2005/001094

§ 371 (c)(1),
(2), (4) Date: Jan. 24, 2007

(87) PCT Pub. No.: WO2006/010204

PCT Pub. Date: Feb. 2, 2006

(65) Prior Publication Data

US 2008/0000903 A1 Jan. 3, 2008

(30) Foreign Application Priority Data

| | | |
|---|---|---|
| Jul. 28, 2004 | (AU) | 2004904178 |
| Aug. 2, 2004 | (AU) | 2004904282 |
| Nov. 4, 2004 | (AU) | 2004906329 |
| Mar. 23, 2005 | (AU) | 2005901415 |

(51) Int. Cl.
*B65D 88/34* (2006.01)
*B65D 88/38* (2006.01)

(52) U.S. Cl. ..... 220/216; 220/218; 220/219

(58) Field of Classification Search ..... 220/216, 220/218, 219, 367.1, 4.24; 215/231; 4/507, 4/498, 499; 52/302.1; 405/26, 63
See application file for complete search history.

(56) References Cited

U.S. PATENT DOCUMENTS

| | | | | |
|---|---|---|---|---|
| 3,349,945 | A * | 10/1967 | Baker | 220/216 |
| 3,938,338 | A * | 2/1976 | Cullen | 405/21 |
| 3,993,214 | A * | 11/1976 | Usab | 220/218 |

(Continued)

FOREIGN PATENT DOCUMENTS

| | | | |
|---|---|---|---|
| AU | 2004100619 | A | 8/2004 |
| CH | 580734 | A | 10/1976 |

(Continued)

OTHER PUBLICATIONS

Written Opinion and International Search Report for International Application No. PCT/AU2005/0001094 dated Jul. 25, 2005.

(Continued)

*Primary Examiner* — Robin Hylton
(74) *Attorney, Agent, or Firm* — Blakely, Sokoloff, Taylor & Zafman

(57) ABSTRACT

A floating modular cover for a water storage consisting of a plurality of modules in which each module includes a chamber defined by an upper surface and a lower surface there being openings in the upper surface to allow ingress of water into said chamber and openings in the upper surface to allow air to flow into and out of said chamber depending on the water level within said chamber to provide ballast for each module floats. The modules prevent water evaporation from the area covered and the shape and size is selected to ensure that the modules are stable in high wind conditions and don't form stacks. The modules may be made from identical hexagonal or octagonal halves by blow molding or thermoforming.

7 Claims, 11 Drawing Sheets

U.S. PATENT DOCUMENTS

| | | | | |
|---|---|---|---|---|
| 4,028,750 | A * | 6/1977 | Gustafsson | 4/498 |
| 4,366,806 | A | 1/1983 | Acker | |
| 4,749,606 | A * | 6/1988 | Moore | 428/166 |
| 5,511,536 | A * | 4/1996 | Bussey et al. | 126/565 |

FOREIGN PATENT DOCUMENTS

| | | | |
|---|---|---|---|
| DE | 19960001 | | 6/2001 |
| DE | 19960001 | A1 | 6/2001 |
| ES | 2189594 | | 1/2003 |
| ES | 2189594 | A1 | 7/2003 |
| FR | 2600697 | A | 12/1987 |
| FR | 2600697 | | 12/1997 |
| GB | 1008495 | | 10/1965 |
| GB | 1008495 | A | 10/1965 |
| NL | 1002693 | | 6/1996 |
| WO | WO-98/12392 | A | 3/1998 |
| ZA | 9503917 | A | 3/1996 |

OTHER PUBLICATIONS

Supplemental European Search Report for International Application No. PCT/AU2005001094 dated Sep. 25, 2008.

Supplementary European Search Report dated Sep. 10, 2008; EP Appl No. 05763092.

* cited by examiner

WATER STORAGE EVAPORATION CONTROL

BACKGROUND TO THE INVENTION

In regions of high evaporation and seasonal rainfall water loss from large open storages due to evaporation is high and is difficult to control.

Evaporation control in relatively small areas of a few hectares or less is usually achieved with a cover over the total surface and anchored at the edges. Australian Patent Application No. 198429445 discloses a water evaporation suppression blanket comprising of interconnected buoyant segments cut from tyres cut orthogonal to the axis of the tyre and assembled in parallel or staggered array.

Australian Patent Application No. 199964460 discloses a modular floating cover to prevent loss of water from large water storages through the natural process of evaporation. Comprising of modular units joined together by straps or ties, manufactured from impermeable polypropylene multi-filament, material welded together to form a sheet with sleeves. The sleeves are filled with polystyrene or polyurethane floatation devices to provide flotation and stiffness to the covers. Australian Patent Application No. 200131305 discloses a floating cover with a floating grid anchored to the perimeter walls of the reservoir, and floating over the liquid level inside the reservoir. A flexible impermeable membrane is affixed to the perimeter walls and is loosely laid over the floating grid.

International Patent WO 02/086258 discloses a laminated cover for the reduction of the rate of evaporation of a body of water, the cover comprising of at least one layer of material that is relatively heat reflecting, and a one second layer of material that is relatively light absorbing.

These prior art devices are restricted to coverage of limited areas by their inherent:

Dynamic inflexibility on the water surface

The need for a fixing mechanism between the modules and/or affixing to the perimeter of the water storage The need to be anchored and held down during high winds.

International Patent WO 98/12392 discloses a modular cover for large areas consisting of flat polygonal floating body where the faces of the floating body have partly submerged vertical walls with lateral edges. The device has an arched cover with a hole in the top cover for air exchange. Although the wall depth is large under wave and local high surface wind conditions the covers can be blown off the water surface and overturned.

There is a need for a modular device, which can be easily laid onto large or small water surface areas that will be stable in high wind and wave conditions and remain stable.

BRIEF DESCRIPTION OF THE INVENTION

To this end the present invention provides a floating modular cover for a water storage consisting of a plurality of modules in which each module includes a) an upper surface
b) a lower surface
c) side walls
d) a chamber defined by the upper surface, lower surface and side walls
e) flotation means associated with said side walls
f) openings in said lower surface to allow ingress of water into said chamber
g) openings in said upper surface to allow air to flow into and out of said chamber depending on the water level within said chamber.

The provision of a closed chamber ensures that water within the chamber functions as ballast preventing the module from being easily blown around or overturned. The openings in the lower surface are large enough to allow water to quickly flow into the chamber when the module is placed into the water storage but small enough to only allow drainage to occur slowly. This is a key difference between the present invention and the device disclosed in WO 98/12392.

The shape of the module is chosen to provide a large surface cover and the periphery is polygonal, the number of sides determined by the application to allow packing of the modules on the water surface.

a) Hexagonal shaped periphery will tessellate in a closest pack arrangement and will give a greater than 90% cover over the water body
b) Octagonal shaped periphery will tessellate with rectangular spaces between the modules and will give about an 82% cover over the water body
c) In all cases the module chord section dimension is preferably 1.2 meters Although it is possible to link the modules together it is preferred not to have any interconnection between the modules to make manufacture and installation simple. In use the modules will tend to accumulate in an area dictated by the prevailing winds and the area of coverage will depend on the number of modules used. The shape of the individual modules and the movement between them will conserve water storage by limiting the evaporation of the water without interfering with the aqua culture because sufficient area will be exposed to allow oxygenation of the water. It is possible to use ropes or cables to constrain a group of modules to a particular location.

In a preferred embodiment the upper and lower surfaces are identical with identical openings for water and air ingress and egress. This makes installation easier as the modules don't have to be laid with a particular surface on top. Ideally the modules can be pushed edgewise to the water to hasten the filling with water ballast.

A baffle may be positioned between the upper and lower surfaces to create two chambers. The upper and lower surfaces may be fluted to strengthen the body and facilitate fluid flow over the surface. Preferably the ridges and valleys of the fluted surface form a multi-point star pattern on the surface which is effective as an omni directional wind lift spoiler.

The flotation device may be any suitable arrangement to provide buoyancy for the module sufficient to allow the ballasted module to float at the surface of the water storage.

In another preferred aspect the modules are designed to allow manufacture on site to avoid the need for transportation from the manufacturing location. Blow moulding or thermoforming is a preferred manufacturing method because blow moulding or thermoforming equipment is able to be moved and set up in temporary facilities on site.

On site manufacture of the module minimises installation costs.

In a preferred embodiment the module:

a) is constructed with a standard blow moulding or thermoforming process;
b) incorporates a UV stabilizer mixed with the plastic moulding material. The formulation determines the exposed life of the module
c) is preferably coloured white to reflect as much light and heat as possible to keep the water cool, and the water vapor pressure as low as possible.

DETAILED DESCRIPTION OF THE INVENTION

Several embodiments of the invention will be described with reference to the drawings in which.

Figure 1:
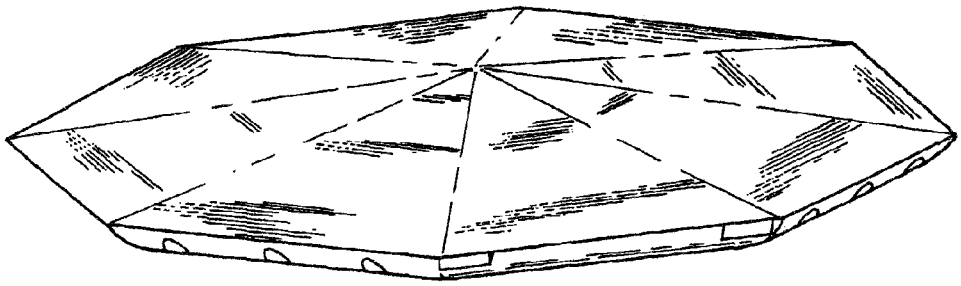
FIG. 1 is a perspective view of a first embodiment of the invention.
Figure 2:
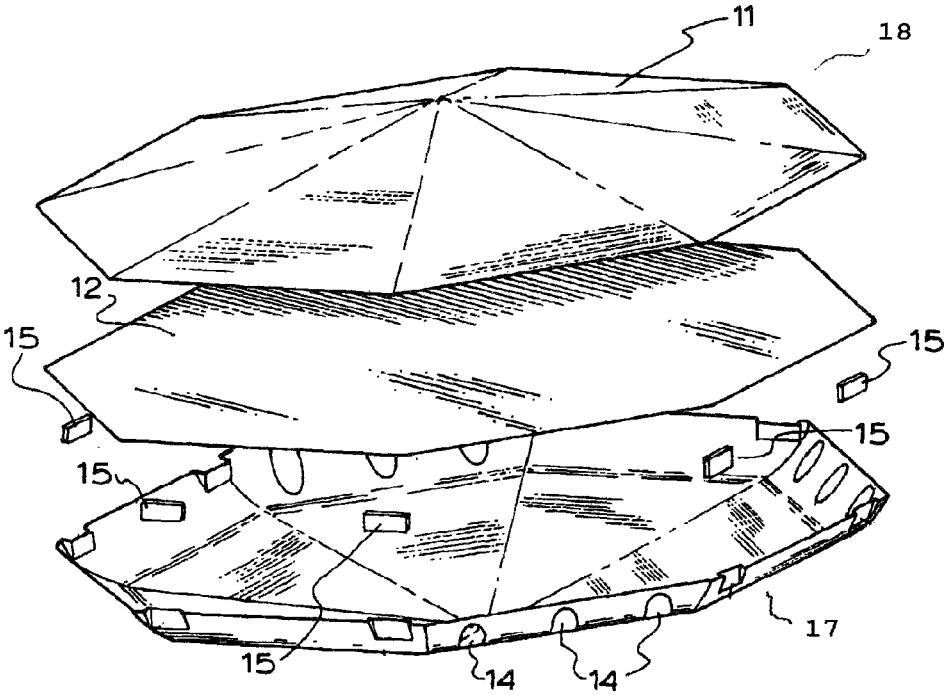
FIG. 2 is a top perspective of an exploded view of the embodiment of FIG. 1.
Figure 3:
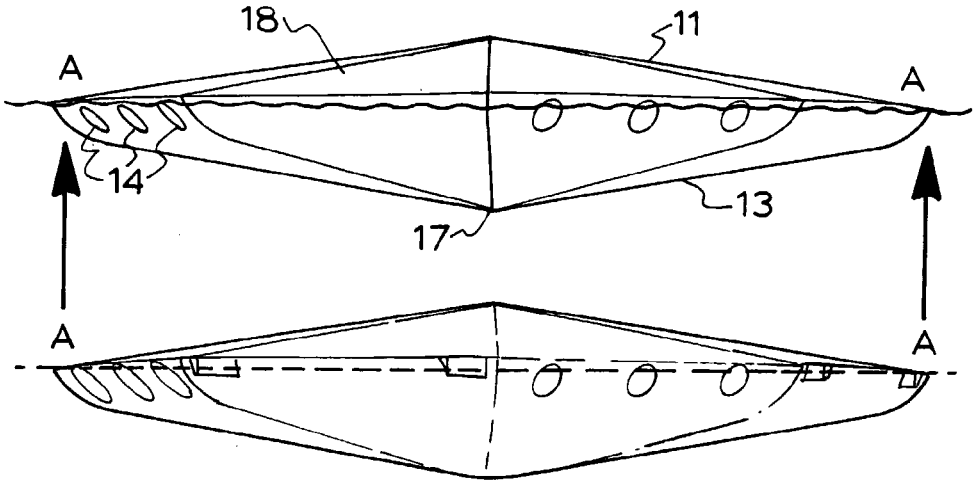
FIG. 3 is a side view and side schematic view of the embodiment in FIG. 1.
Figure 4:
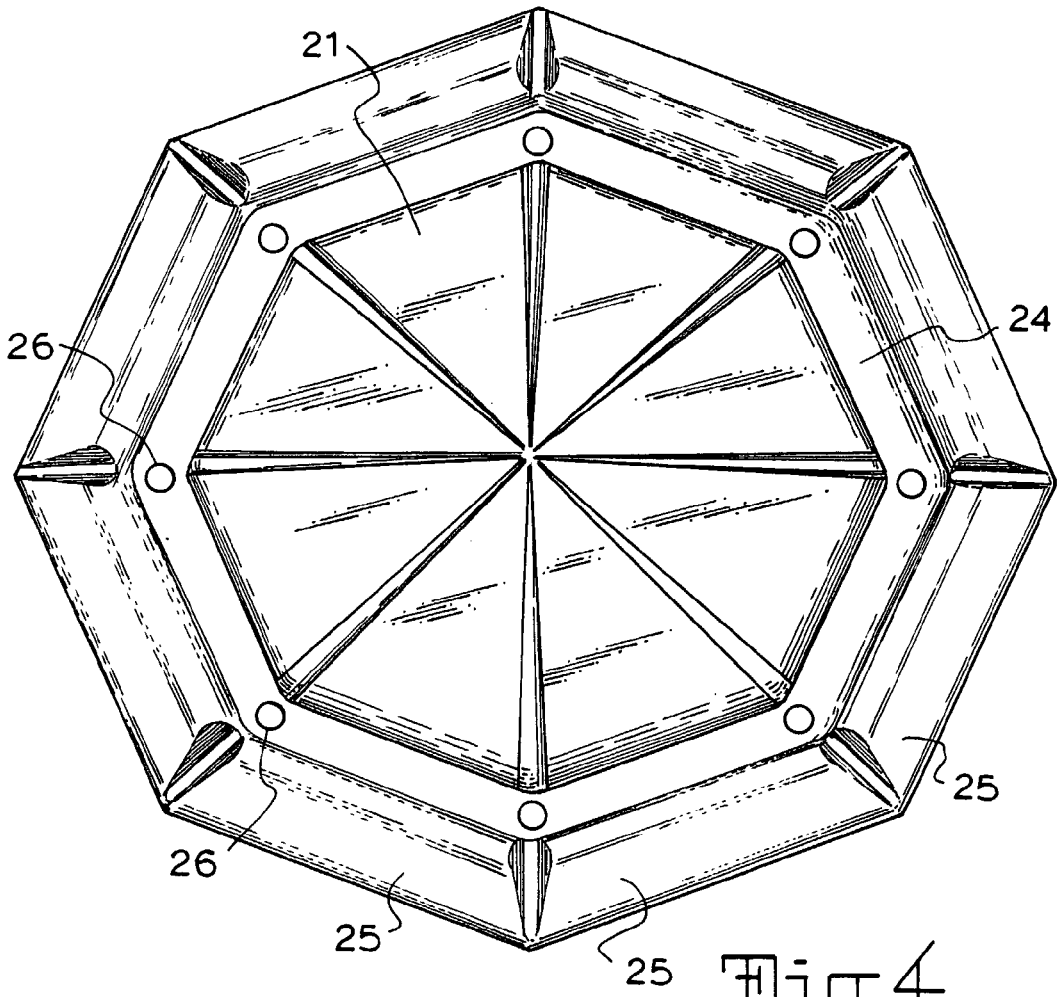
FIG. 4 is a top perspective view of a second embodiment of this invention.
Figure 5:
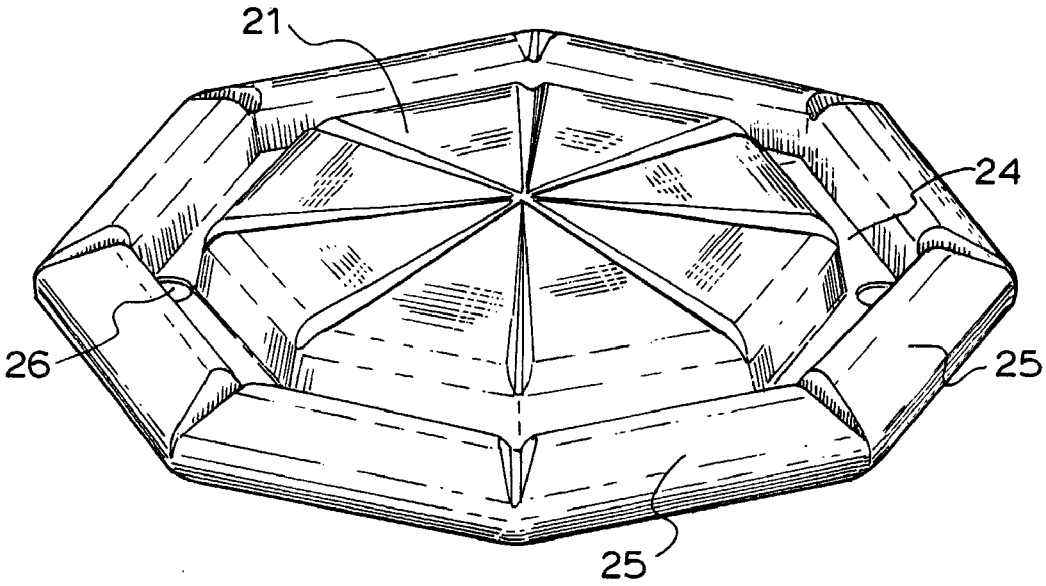
FIG. 5 is a top isometric view of a second embodiment of this invention.
Figure 6:
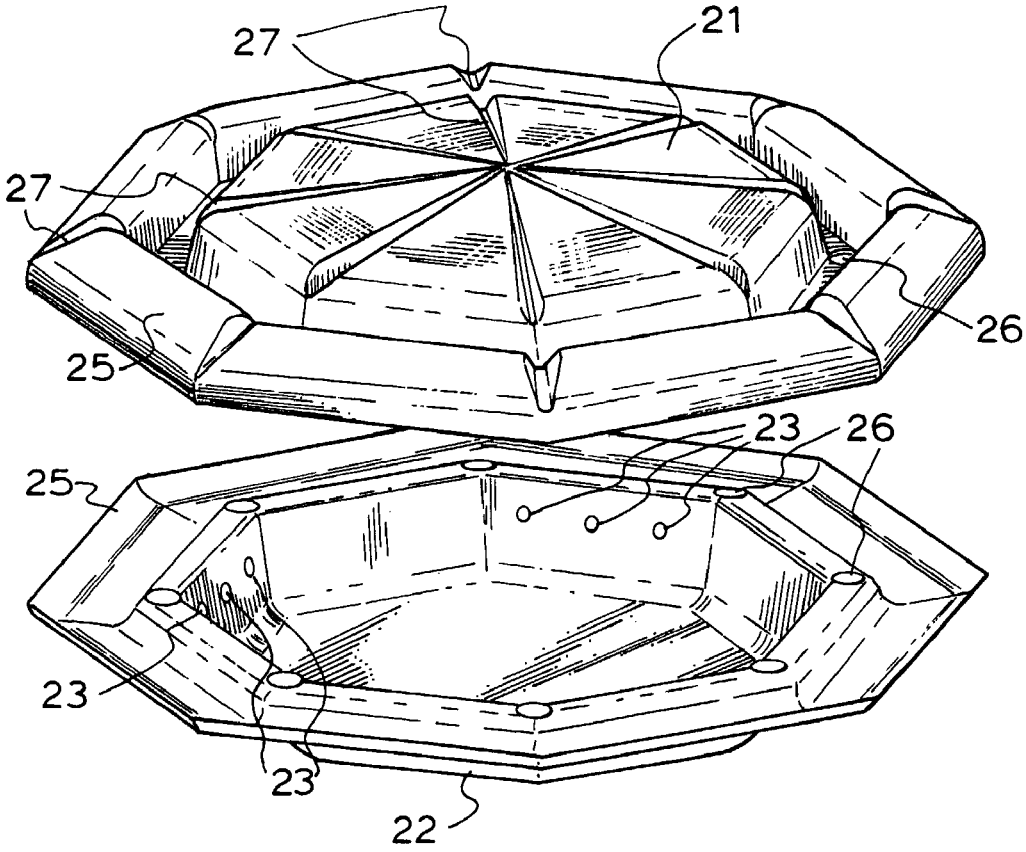
FIG. 6 is a top perspective of an exploded view of the embodiment of FIG. 5.
Figure 7:
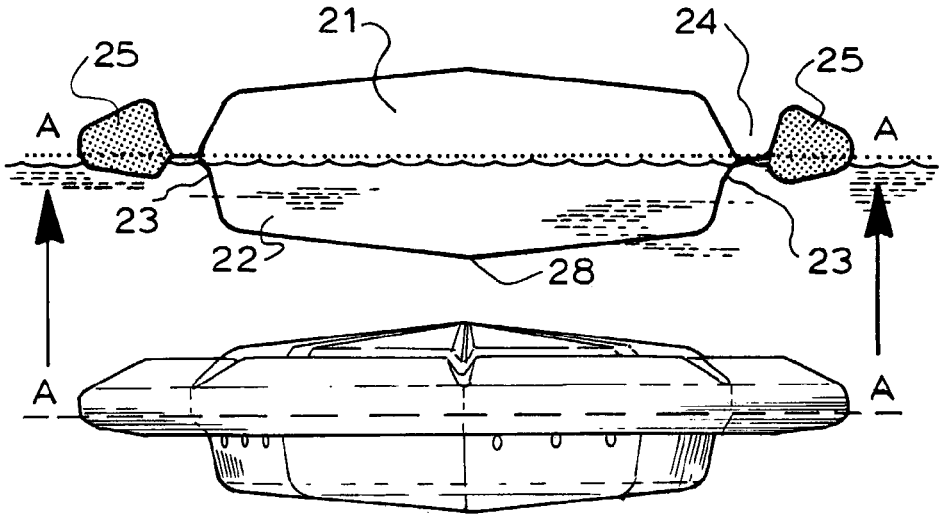
FIG. 7 is a side view and side schematic view of the embodiment of FIG. 5.
Figure 8:
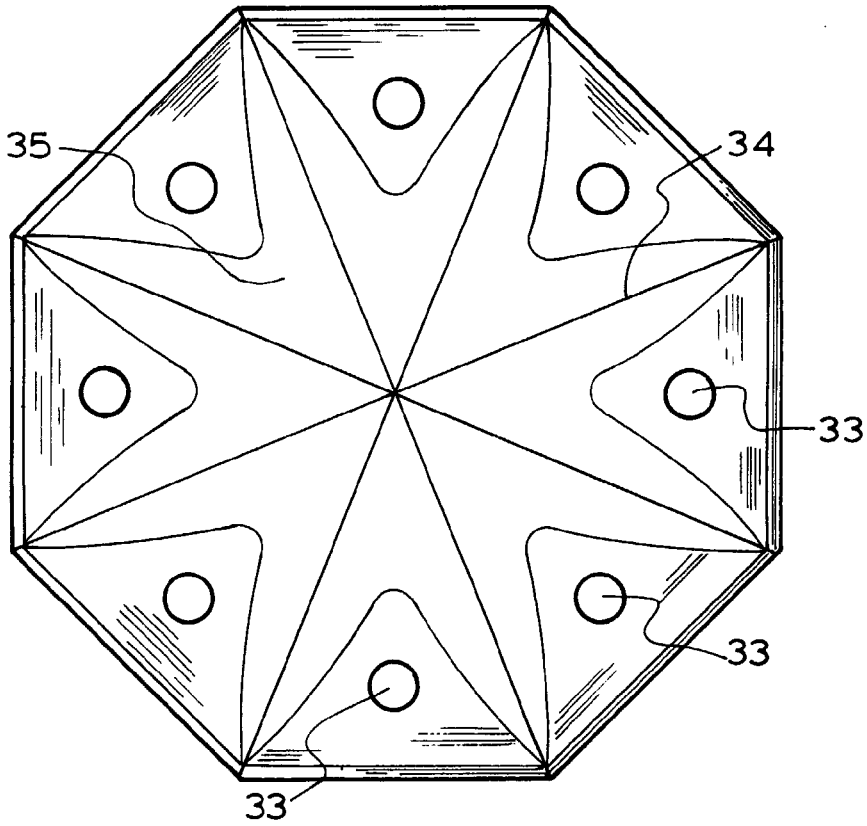
FIG. 8 is a top plan view of a third embodiment of this invention.
Figure 9:
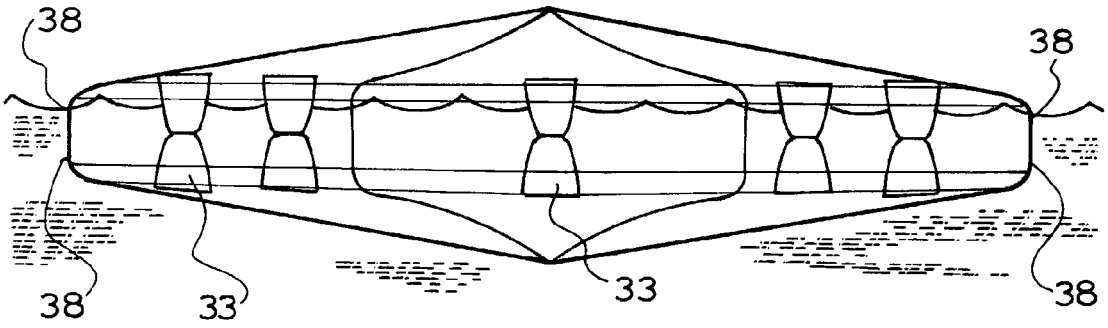
FIG. 9 is a side schematic view of the embodiment of FIG. 10.
Figure 10:
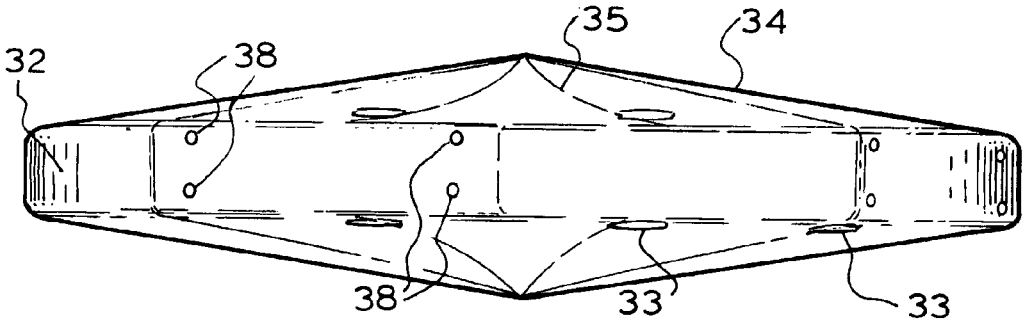
FIG. 10 is a side view of the embodiment of FIG. 10.
Figure 11:
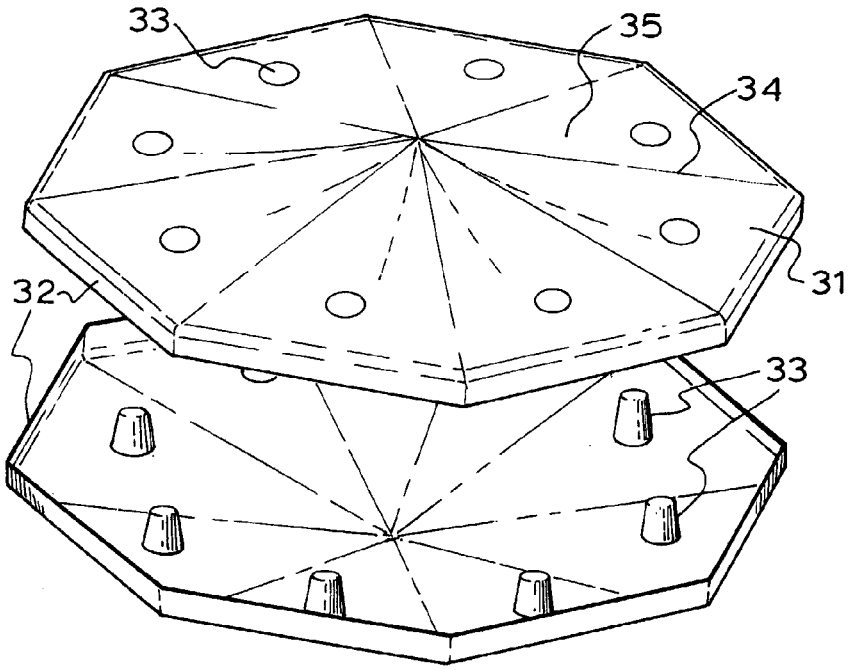
FIG. 11 is a top perspective of an exploded view of the embodiment of FIG. 10.
Figure 12:
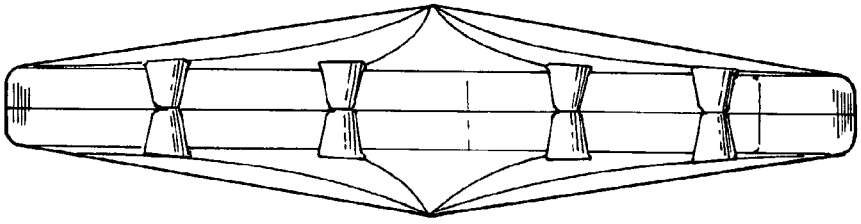
FIG. 12 is a section view of the interior of the embodiment of FIG. 10.
Figure 13:
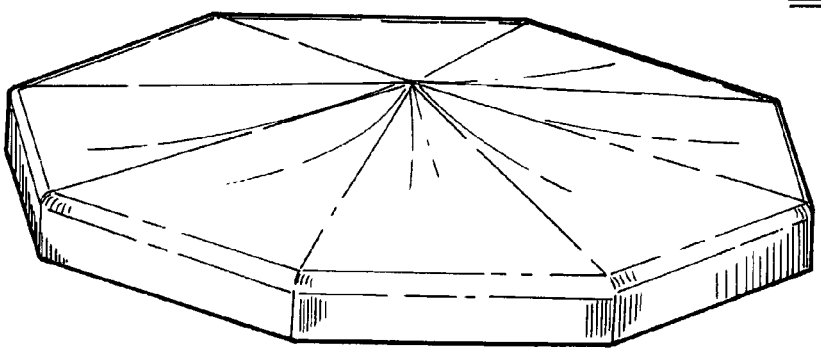
FIG. 13 is a top isometric view of the embodiment in FIG. 10 with the flotation fingers covered.
Figure 14:
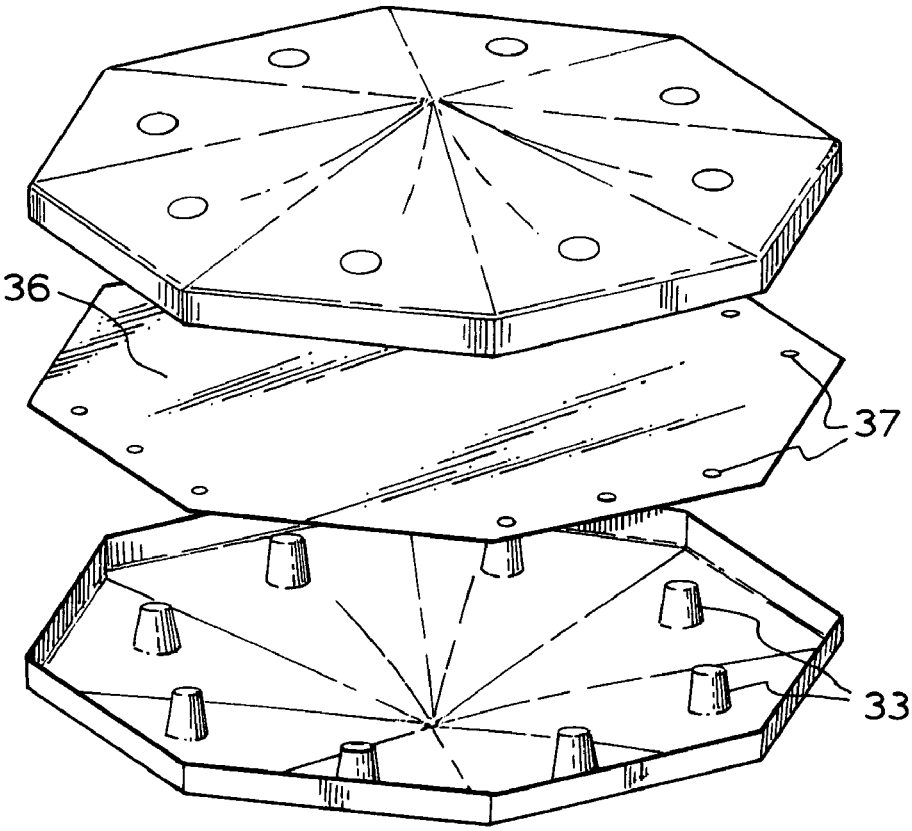
FIG. 14 is a top exploded view of the embodiment in FIG. 10 with the baffle inserted.
Figure 15:
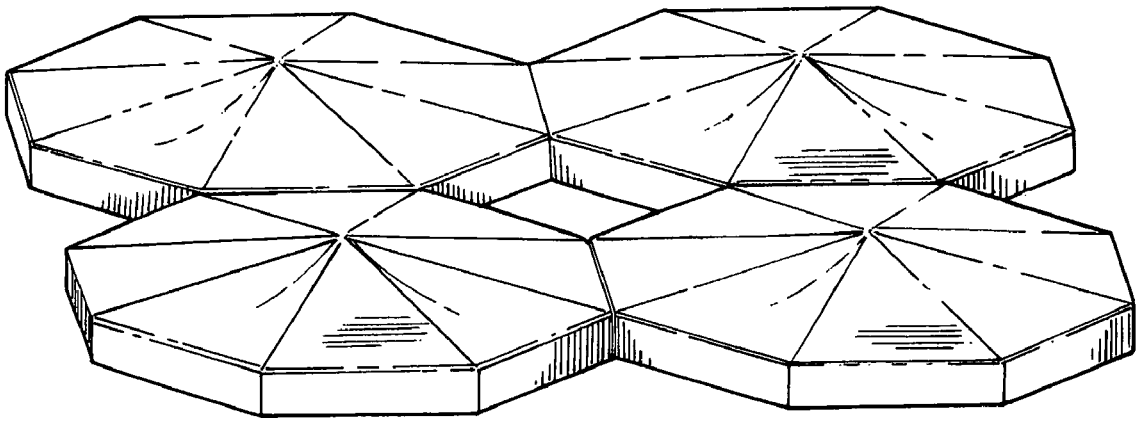
FIG. 15 is an isometric view of four octagonal modules in closest pack arrangement of the embodiment in FIG. 10.
Figure 16:
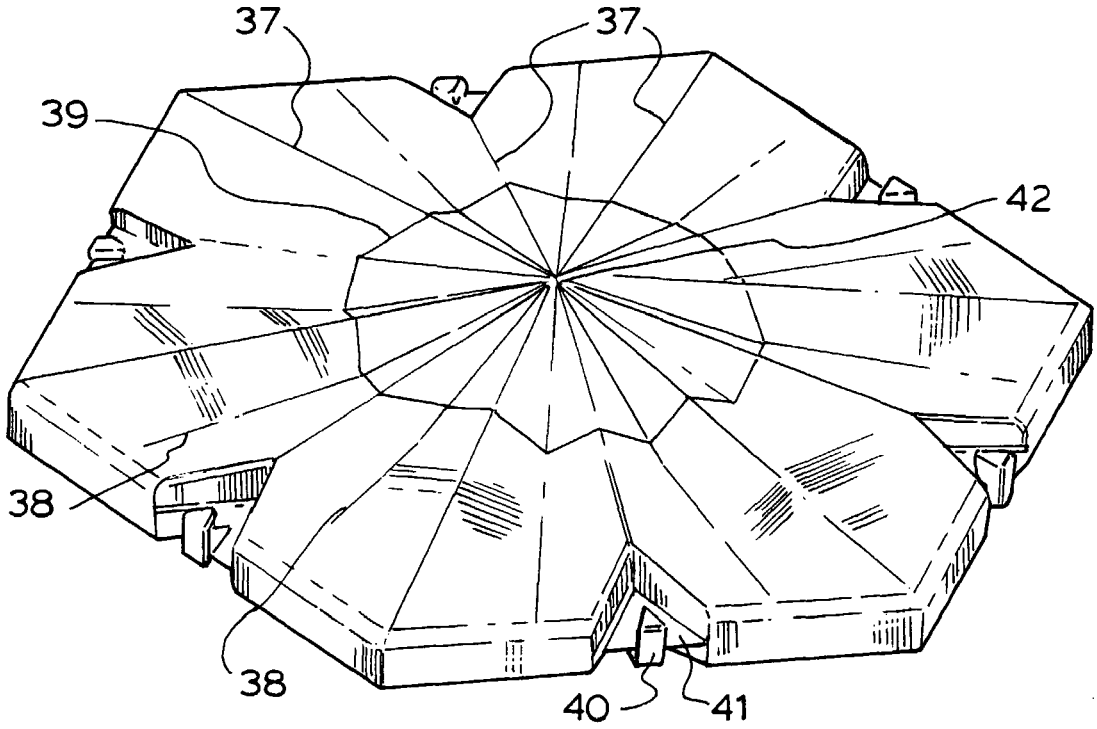
FIG. 16 is a top isometric view of a fourth hexagonal embodiment of this invention.
Figure 17:
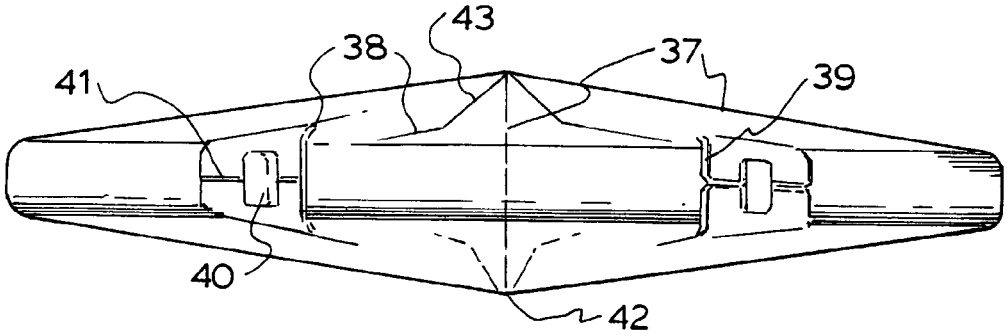
FIG. 17 is a right side view of the embodiment of FIG. 16.
Figure 18:
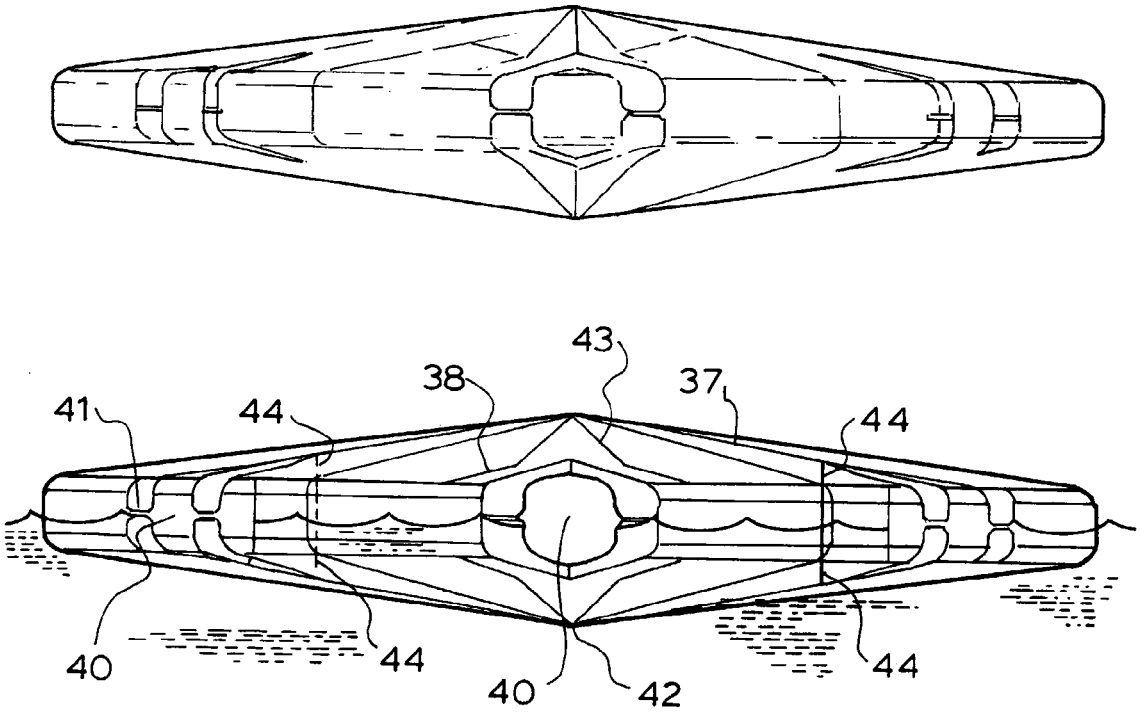
FIG. 18 is a front side section view of the embodiment of FIG. 16 with enlarged floatation pods.
Figure 19:
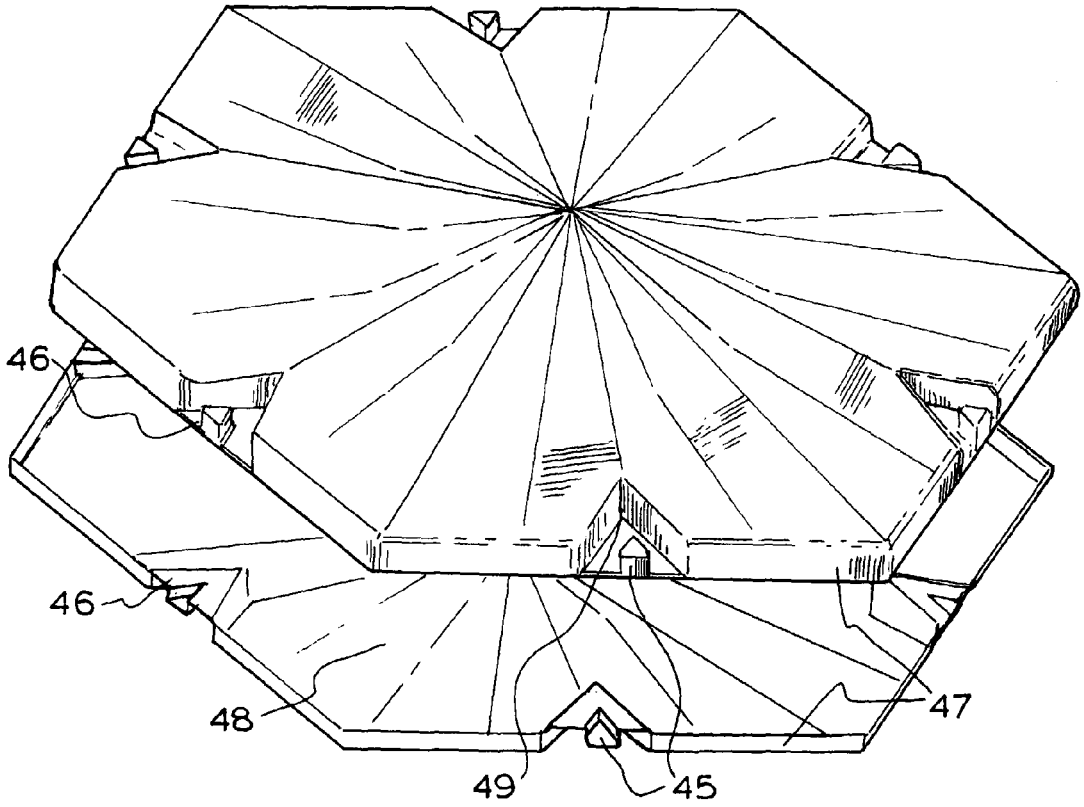
FIG. 19 is an exploded isometric view of the embodiment of FIG. 16.

In a first embodiment as shown in FIG. 1 and 2 the module is formed from 3 components clipped together. The module is an octagonal pyramid in shape with two chambers. The top section 11 forms a sealed flotation chamber with the separator 12. The flotation chamber 18 can be filled with a foam to increase module strength and ensure flotation if pierced. The bottom section 13 has water access holes 14 in its sides and the bottom hole 7, so that the water ballast chamber formed by separator 12 and lower section 13 can fill with water when the module is placed on the water. Access holes 14 and 17 are large enough to allow water to flow into the chamber and allowing for limited passage of the water keeping it fresh, whilst small enough to restrict the drainage. The pitch of the upper surface is designed to allow rain and debris to fall off. The 3 sections may be clipped together using clips 15 or alternatively they can be welded to form air tight seals.

In a second embodiment shown in FIGS. 4 to 7 the module has a central ballast chamber with ingress for air and water ballast and a peripheral floatation ring. The upper surface 21 and lower surface 22 are sealed together by the peripheral flange or collar 24 to which the flotation ring 25 is attached. Water access holes 23 are provided in the lower section 22 so that the chamber formed by sections 21 and 22 fills with water and allows for limited passage of the water keeping it fresh, whilst also providing water ballast for the module. The water access holes 23 are large enough to allow water to flow into the chamber but small enough to restrict the drainage. Air holes 26 are provided in the collar 24 to provide venting for water access holes 23, and to equalize the pressure during wind blasts between the upper and lower chamber. The sections 21 and 22 are formed from Ultra Violet (UV) stable materials that can be blow moulded, thermoformed or injection moulded. The inner octagonal submerged pyramid formed by section 22 when flooded has a restricted drain hole 28 retaining the water as ballast and greater interior volume than the top octagonal pyramid to prevent lifting of the module in high wind areas.

The outer octagonal torus 25 has an outer pitch of 300, which inhibits the modules stacking on top of each other during exposure to inclement weather and high wind situations. Both inner octagonal pyramids have an outer pitch designed to allow rain and debris to slide off the module.

The third embodiment of the invention shown in FIGS. 8 to 15 provides a module with identical top and bottom sections so that either surface can be submerged. The module is blow moulded or thermoformed with surfaces 31 and side edges 32. To assist in forming a ballast chamber the two surfaces are spaced apart and strengthened by the fingers or buoyancy chambers 33 which can be formed during moulding and later sealed to provide sufficient buoyancy for the modules. The buoyancy chambers 33 are designed to provide the module with horizontal floatation on the water body surface. The side edges 32 can incorporate vent holes 35 for ingress and egress of air and water. The side edges 32 are designed to reduce the wear and tear of the modules from wind and water buffeting by being 90% submerged and therefore being water cushioned. The module surfaces are fluted with ridges 34 and valleys 35 to reduce lift during high wind conditions. The ridges 34 can be linear or curved section depending on the wind conditions. The valleys 35 have an exponential or parabolic curve section. The combination of the ridges and valleys forms a star type pattern on the surface being effective as a omni directional wind lift spoiler.

Ballast control in extreme weather conditions can be effected by placing a baffle 36 within the module. The baffle has holes through it 37, which provide limited access to the now top and bottom parts of the module. The baffle further reduces the lift on the module by restricting the horizontal ballast distribution of the module. The modules are usually 1.2 meters and the flotation and shape of the inner chamber enables the ballast to be of the order of 150 kilograms.

The fourth embodiment of the invention shown in FIGS. 16 to 19 provides a module with identical top and bottom sections so that either surface can be submerged as with the previous third embodiment. The hexagonal shape allows closer packing of the modules on a dam surface than does the octagonal modules. These are particularly useful where water quality and aeration is not as important. The module is specifically designed to be thermoformed on site in a single process using a purposely designed, transportable, double sided thermoforming facility. The polymer sheeting can be single or preferably dual layer. The top layer master-batched with Titanium Oxide to produce a white (and hence light reflective) layer, the bottom layer master-batched with carbon to enhance the UV opacity of the polymer. Both polymer master-batches are also mixed with VU stabilizers to prolong the exposed life of the polymer. The design of this embodiment is similar to the third embodiment except that the fingers or buoyancy chambers 33 have been moved from the interior of the module to the perimeter as pods 40. The top and bottom pyramidal chambers of this embodiment have more folds (or corrugations), shown as ridges 37 and valleys 38, to enhance the strength of the module. The gradient of the valleys 43 increases as the valley approaches the apex 42 of the device, specifically designed to reduce lift during high wind conditions. The combination of the ridges and valleys forms a multi-point star type pattern on the surface being effective as an omni directional wind lift spoiler. The perimeter 46, surrounding the top and bottom pod flotation shell 45 of the module, is heat and compression sealed in the thermoforming process to produce the flotation pod 40. The apex of the perimeter wall fillet 49 can incorporate vent holes for ingress and egress of air and water. The edges 47 of the top and bottom sides of the module are sealed together in the thermoforming process creating the interior cavity 48 of the module.

Figure 20:
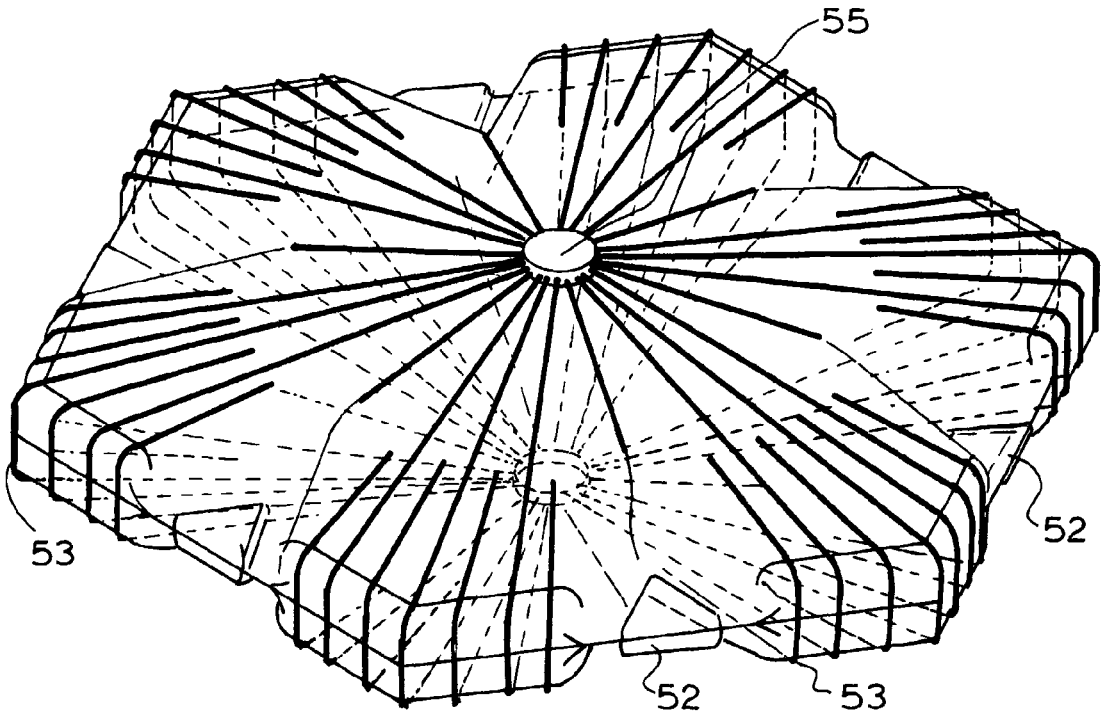
FIG. 20 is a top isometric view of a fifth embodiment of the invention.
Figure 21:
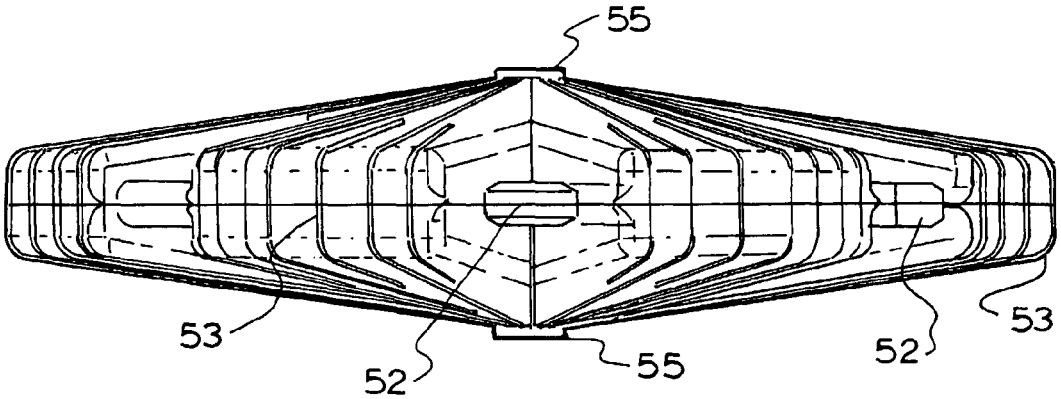
FIG. 21 is a side view of the embodiment of FIG. 20.

The embodiment of FIGS. 20 and 21 is another hexagonal module adapted to be thermoformed from large sheets of high density polyethylene (HDPE). The two portions of the modules are identical. The sheets may be as thin as 0.5 mm and formed into two identical halves in a two mold unit and then pressed and heat welded together at the periphery. Each side of the module has a flotation pod 52. The flotation pod ensures that the modules stand proud of the water surface with the lower portion of the module is filled with water ballast. The module surfaces are reinforced by an array of embossed ribs 53 approximately 5 mm square. These ribs 53 radiate from the sides toward the central hub 55. The two hubs 55 incorporate holes for ingress of water or air. In other respects the modules shown in FIGS. 20 and 21 function similarly to the earlier described embodiments.

For large and remote water storages the modules of each of the embodiments may be manufactured on site using a transportable blow moulding, and/or thermoforming facility that can be erected in a temporary building. For example the embodiment of FIGS. 20 and 21 may be made by a thermoforming machine having two mould cavities mounted on a low loader that can be transported to the water storage. The moulded modules can then be placed in the water and will fill with ballast to provide cover for the water and reduce evaporation. Once a significant proportion of the water surface is covered the evaporation savings are significant. The modules are made from weather resistant polymeric materials and will have a useful life of at least 10 years.

From the above it can be seen that the present invention provides a unique solution to water evaporation control. Those skilled in the art will also realize that this invention can take many forms apart from those described without departing from the essential teachings of this invention.

The invention claimed is:

1. A polygonal module for a floating water cover comprising:

an upper shell defining an upper surface;

a lower shell defining a lower surface and sealed to the upper shell;

a central ballast chamber defined by the upper shell and the lower shell;

openings in the lower shell to allow ingress of water into the central ballast chamber to provide ballast for the polygonal module, the polygonal module having a plurality of sides;

openings in the upper shell to allow air to flow into and out of the central ballast chamber depending on the water level within the central ballast chamber; and a plurality of flotation chambers members coupled to the central ballast chamber on the sides of the polygonal module, wherein the plurality of flotation chambers and the central ballast chamber are configured to be formed by the sealing of the upper shell and the lower shell to each other.

2. The polygonal module for the floating water cover as claimed in claim 1 in which the upper and lower shells are functionally identical.

3. The polygonal module as claimed in claim 2 in which the plurality of flotation chambers include a plurality of flotation cells located on each side.

4. The polygonal module for the floating water cover as claimed in claim 1 in which an outer surface of the upper shell is pitched so that rain or debris does not remain on the surface.

5. The polygonal module as claimed in claim 2 in which the outer surfaces of the shells are fluted or ribbed to reinforce the upper and lower shells of the polygonal module.

6. The polygonal module as claimed in claim 2 in which the upper and lower shells define an hexagonal or octagonal pyramid.

7. The polygonal module as claimed in claim 2 in which each of the upper and lower shells are made by blow moulding or thermoforming.

* * * * *